United States Patent [19]

Schmidt et al.

[11] 4,029,914

[45] June 14, 1977

[54] MULTIPLE SWITCH MECHANISM

[75] Inventors: Gary M. Schmidt, Cleveland; Robert J. Gabor, Mentor; John T. Venaleck, Painesville, all of Ohio

[73] Assignee: A P Products Incorporated, Painesville, Ohio

[22] Filed: Apr. 14, 1976

[21] Appl. No.: 676,900

[52] U.S. Cl. ..... 200/1 R; 200/5 R; 200/16 D; 200/18; 200/275; 200/292; 200/293

[51] Int. Cl.[2] ..... H01H 9/00; H01H 15/00

[58] Field of Search ..... 200/1 R, 5 R, 5 A, 11 DA, 200/16 R, 16 C, 16 D, 17 R, 18, 60, 159 B, 164 R, 252–261, 292, 293–296, 303, 284, 308, 275

[56] References Cited

UNITED STATES PATENTS

| | | | |
|---|---|---|---|
| 3,582,578 | 6/1971 | Lockard | 200/16 D |
| 3,586,797 | 6/1971 | Gerhardt et al. | 200/292 X |
| 3,624,320 | 11/1971 | Eberhart et al. | 200/16 D X |
| 3,728,499 | 4/1973 | Bang et al. | 200/16 D X |
| 3,806,685 | 4/1974 | Seeger, Jr. et al. | 200/159 B X |
| 3,886,341 | 5/1975 | Forrest | 200/60 X |
| 3,896,276 | 7/1975 | Held | 200/16 D X |
| 3,963,884 | 6/1976 | Pollock | 200/16 D |
| 3,971,903 | 7/1976 | Wilentchik | 200/16 C |
| 3,974,346 | 8/1976 | Keprda | 200/16 D X |

FOREIGN PATENTS OR APPLICATIONS

| | | | |
|---|---|---|---|
| 2,524,287 | 12/1975 | Germany | 200/16 D |

OTHER PUBLICATIONS

Western Electric, Technical Digest No. 9, Jan. 1968, p. 25, J. S. Baynard, Jr. et al., "Boroprobe".

*Primary Examiner*—James R. Scott
*Attorney, Agent, or Firm*—Donnelly, Maky, Renner & Otto

[57] ABSTRACT

A multiple switch device is connectable on-line between a multiple conductor electrical cable termination assembly or the like and a receptacle or the like to which the assembly would otherwise be connected. The multiple switch device includes a plurality of slide switches that are selectively actuable to open or to close respective circuits between such assembly and such receptacle.

16 Claims, 3 Drawing Figures

MULTIPLE SWITCH MECHANISM

BACKGROUND OF THE INVENTION

The present invention relates, in general, to a multiple switch device and, in particular, to an off board, on-line multiple switch device for selectively opening and closing circuits in a multi-conductor electrical cable termination assembly.

Multi-conductor electrical cables, such as flat ribbon-type cables, are employed, for example, to provide simultaneous electrical connection of a plurality of circuits at one location to another plurality of circuits at another location. To facilitate connecting such a cable to such circuits respective multiple contact terminations are secured at each end of the cable to connect the conductors thereof with respective contacts of a multiple contact receptacle, or the like, which terminate such circuits. The combination of such a multi-conductor electrical cable and a termination therefor is usually referred to as a multi-conductor electrical cable termination assembly, cable termination assembly, or the like.

Typically such multi-conductor electrical cables of the flat ribbon-type, for example, have more than two and usually on the order of from about 20 to about 50 or even more conductors, and the terminations therefor include a corresponding number of electrical contacts arranged in two parallel rows in a conventional dual-in-line pattern for facility of manipulation and compactness. Moreover, such terminations usually may be categorized as either female or male type, depending on the type of electrical contact employed therein, such as, for example, fork contacts or pin contacts, respectively.

An advantage of such usage of cable termination assemblies is the facility with which many connections can be simultaneously made. Another advantage is the relative compactness of the cable termination assembly, which enables those many connections to be made in a relatively small space. However, one disadvantage encountered in the past using such cable termination assemblies has been the inability to switch open or closed selected conductor circuits therefor with facility while at the same time maintaining the above and other advantages.

SUMMARY OF THE INVENTION

The multiple switch device of the present invention is an off-board device, i.e. not necessarily located on a circuit board or other electrical apparatus, that is connectable between a cable termination assembly and its receptacle in on-line relation to both the assembly termination and its receptacle, i.e. physically present adjacent both. In other words, on-line means that the multiple switch device is connectable physically as an extension of a multi-conductor cable termination assembly between the latter and its receptacle, as opposed to being a remotely located device, and this on-line feature, therefore, facilitates overall circuit assembly, reduces circuit materials, enhances the integrity of the connections, and so on. Receptacle, as used herein, refers to any device adapted for connection with a cable termination assembly, whether the termination of another such assembly, a socket or terminal of a circuit board, of a computer or of any other electrical apparatus, etc. When so connected on-line, the multiple switch device may be selectively adjusted to open or to close each of the conductor circuits between the cable termination assembly and its receptacle while still maintaining the mentioned facility of connection and compactness advantages.

In one form the invention comprises a plurality of switch circuits located within a common compact housing and electrical contacts connected to opposite sides of each switch circuit. The electrical contacts at one side of the switch circuits are arranged in a dual-in-line pattern for connection with the termination of a cable termination assembly, and the electrical contacts at the other side of the switch circuits are similarly arranged in a dual-in-line pattern for connection with the receptacle, whereby the multiple switch device may be connected to form an extension portion directly on-line with the assembly and receptacle.

With the foregoing in mind it is a principal object of the invention to switch open and closed selectively the respective circuits of a multi-conductor electrical cable termination assembly.

Another object is to switch open and closed selectively and directly on-line therewith respective multiple circuits of a cable termination assembly and its receptacle.

An additional object is to open or to close selectively each line in a multi-conductor electrical cable, such as a ribbon cable, for testing, circuit programming, and the like.

A further object is to avoid inadvertent switching of the switches of a multiple switch device.

Still another object is to provide an indication of switching action of a slide action.

Still an additional object is to retain a slide switch in a given position.

Still a further object is to facilitate the manufacture and construction of a multiple switch device.

Yet another object is to avoid undue wearing of a slide switch and thus to increase the longevity thereof.

These and other objects and advantages of the present invention will become more apparent as the following description proceeds.

To the accomplishment of the foregoing and related ends, the invention, then, comprises the features hereinafter fully described and particularly pointed out in the claims, the following description and the annexed drawing setting forth in detail a certain illustrative embodiment of the invention, this being indicative, however, of but one of the various ways in which the principles of the invention may be employed.

DESCRIPTION OF THE PREFERRED EMBODIMENT

Figure 1:
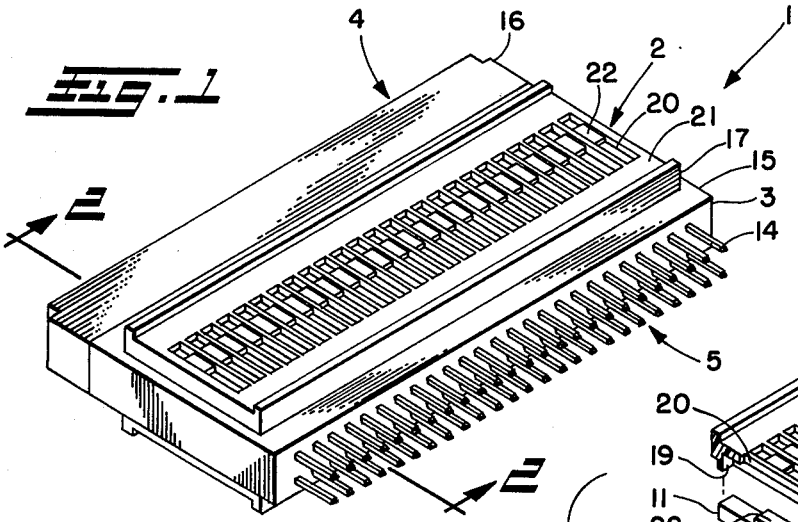
FIG. 1 is an isometric view of the multiple switch device.

Referring now more particularly to the drawing, wherein like reference numerals designate like parts in the several figures, the multiple switch device is generally indicated at 1 in FIG. 1. The fundamental elements of the multiple switch device 1 include a plurality of slide switches 2 located in a dielectric housing 3 for selectively opening and closing circuit paths between a plurality of electrical contacts in a first connecting portion 4 and a plurality of electrical contacts in a second connecting portion 5, respectively.

Figure 3:
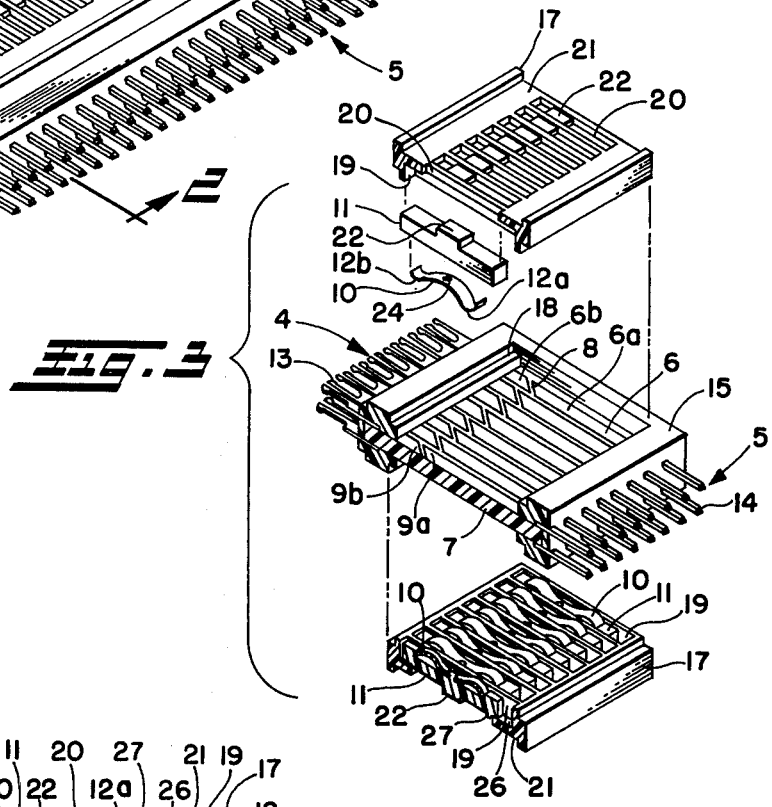
FIG. 3 is a partial exploded isometric view of the multiple switch device with the housing cover removed.

The electrical contacts in the first and second connecting portions 4, 5 are arranged, for example, in respective dual-in-line patterns, which can be seen more clearly in FIG. 3, or they may be arranged in any other desired pattern to facilitate their connection with the respective contacts, for example, of a termination of a cable termination assembly and those of a receptacle with which such assembly may be connected. When the multiple switch device 1 is so connected, each of the slide switches 2 may be selectively adjusted to open or to close respective circuit paths between the contacts of such assembly and such receptacle.

The slide switches 2 comprise a plurality of respective electrically conductive linear traces, strips or other electrical conductors 6 preferably printed or otherwise formed on an electrically non-conductive support 7, as a printed circuit board. Each of the traces 6 is divided at an electrically non-conductive discontinuity 8 into first and second parts 6*a*, 6*b*, and the discontinuities 8, as seen most clearly in FIG. 3, are defined angularly with respect to the linear extent of the traces by confronting, territorially overlapping ends 9*a*, 9*b* of each trace, whereby the most remote point of each trace end extends generally into the territory of the opposing trace end. The slide switches also include respective electrically conductive slide members 10 retained in slide holders 11 and having respective pairs of contacting parts 12*a*,12*b* respectively in engagement with the surfaces of the traces 6.

The slide members 10 preferably are resilient, and the slide holders 11 in cooperation with part of the dielectric housing 3 urge the paired contacting parts 12*a*,12*b* to engagement with the traces 6. Accordingly, each slide member 10 may be slid on its trace 6 to a first, circuit closing, position with the contacting parts 12*a*, 12*b* respectively engaging the trace parts 6*a*, 6*b*, as is shown in the upper half of FIG. 2, or to a second, circuit opening, position with the contacting parts 12*a*, 12*b* engaging only the trace part 6*a*, as is shown in the lower half of FIG. 2. Moreover, the surfaces of the traces with which the slide members 10 are engaged are raised the same amount above the plane of the support 7. However, due to the overlapping extent of each pair of trace ends 9*a*, 9*b*, the contacting parts 12*a*, 12*b* of each slide member 10 will always remain in the same plane as those raised surfaces, and the contacting part 12*b* will not fall into the relative recess at the discontinuity 8 even as it is moved from one trace part to the other. Therefore, wearing of the traces that might occur, if the directional extent of the discontinuities 8 were perpendicular to the linear extents of the traces whereby the contacting parts 12*b* may snap down into the relative recess of each discontinuity and then back up onto the surface of the trace as the slide members 10 are moved to their respective positions, is avoided. Also, due to the non-perpendicular extent of the discontinuities 8, movement of the slide members 10 to their respective positions is with a smooth, continuous action and closure or opening of the respective circuits occurs promptly as soon as each contacting part 12*b* engages or leaves its trace part 6*b*. While in the preferred form of the invention the discontinuity 8 is linear and generally angularly disposed with respect to the linear extent of the trace 6, the discontinuity 8 may be of other non-perpendicular extent, such as, for example, in an undulating-shape or stepped-shape form that provides the described smooth transition experienced as a slide member 10 is moved between its two positions.

The electrically conductive traces 6 are preferably printed or otherwise formed on both the upper and lower surfaces of the printed circuit board 7, and at the forward and rearward ends of each trace are soldered, respectively, a female-type fork contact 13 and a male-type pin contact 14. The lateral spacing of the traces 6, the total thickness of the printed circuit board 7 from the raised trace surface on one side to the raised trace surface on the opposite side, and the dimensions of the contacts 13, 14 are such that the contacts will be arranged in the respective dual-in-line patterns of the first and second connecting portions 4, 5. Of course, it will be appreciated that the form of the contacts and their pattern arrangement may be varied, depending on the cable termination assembly, receptacle, or the like to which the multiple switch device 1 is to be attached.

The dielectric housing 3 includes a main body 15 molded about the perimeter of the printed circuit board support 7 preferably enclosing each of the junctures of the traces 6 and the contacts 13 and 14 soldered thereto to provide a strain relief function. Also, the main body 15 is preferably molded under sufficiently elevated temperature and pressure conditions, for example, in an injection molding machine, to substantially eliminate all of the free oxygen and moisture at these junctures to reduce the possibility of corrosion or other electrolytic-type activity there, and thus, permitting the contacts and traces to be conveniently and relatively inexpensively formed of dissimilar electrically conductive materials. The housing 3 may include a housing cover 16 with front openings and interior walls, not shown, secured to the main body 15 at a step 16*a* in the forward surface of the latter to guide pin contacts to proper engagement with the respective fork contacts 13.

Figure 2:
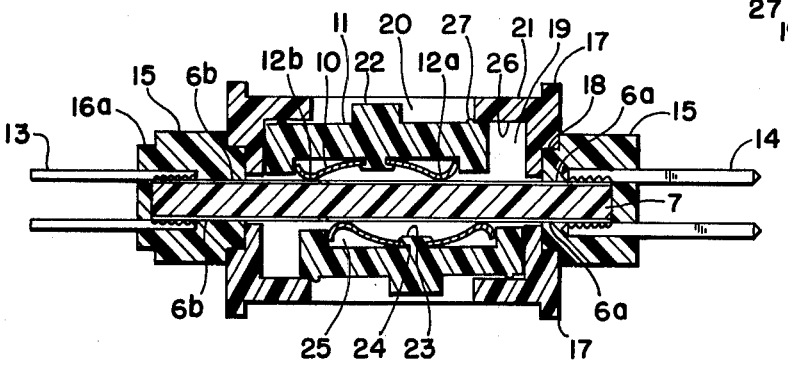
FIG. 2 is a section view of the multiple switch device with the housing cover removed looking generally in the direction of the arrows 2—2 of FIG. 1.

As is illustrated most clearly in FIGS. 2 and 3, the dielectric housing 3 also includes identical upper and lower switch housing inserts 17 placed over the respective traces 6 including, particularly, the discontinuities 8 thereof and joined, for example, by ultrasonic welding or other fastening technique to the main body 15 at respective step junctures 18. A plurality of hollow channels 19 is formed in each insert 17. Each channel 19 is located facing a respective trace 6, and the channels include slotted apertures 20 in the top wall 21 of each switch housing insert 17 for exterior access to the slide holders 11, which are slidably positioned in and guided for movement in alignment with the traces 6 by the respective hollow channels 19. The linear extent or dimension of the slide holders 11 and the linear extent of the slotted apertures 20 are such that regardless of whether the slide holders are in the first, circuit closing, position or second, circuit opening, position, the slide holders will be retained in the hollow channels.

Each slide holder 11, moreover, includes a raised slide actuator 22 that facilitates selective sliding of the slide holder 11 and the slide member 10 therein in a hollow channel 19. Preferably the slide actuators 22 are located beneath the exterior or top plane of the switch housing insert top wall 21 to preclude inadvertent movement of the slide holders 11. In the preferred embodiment the size of the slide actuators 22 and the dimensions of the slotted apertures 20 are such that direct manual movement of the slide holders 11 may be difficult or impossible; rather, it is preferred that a relatively pointed instrument, configured, for example, like a pencil point or the like, may be placed to abutment with respective slide actuators and utilized to effect such movement of the slide holder 11 by a force having initially a slight vertical component and also having a horizontal component, as will become more apparent from the following description.

Each slide member 10 is secured in its respective slide holder 11 by a protrusion 23 of the latter that passes through an opening 24 in its slide member and is peened, squashed or flattened to hold the slide member in place. The slide members 10, which are preferably resilient, have their remote ends beyond the respective contacting parts 12*a*, 12*b* turned upwardly to facilitate bending within respective hollows 25 of the slide holders 11. Those remote ends may engage the opposite walls of the slide holder 11 for retention of the slide member 10 therein without use of the protrusion 23. When the switch housing inserts 17 are assembled in the main housing body 15 with the slide members 10 and slide holders 11 positioned generally as shown in FIGS. 2 and 3, the slide members 10 are resiliently deformed as the contacting parts 12*a*, 12*b* abut the respective traces 6 and the tops of the slide members 10 at their respective openings 24 are urged toward the support 7 by the slide holders 11 and the interior surface 26 of the top wall 21.

Raised bumps or protuberances 27 located near opposite ends of each slide holder 11 provide mechanical, visual and/or audible signals that the slide holder has reached one of its first and second positions and also provide a locking function to hold the slide holder in one of those positions until deliberately moved. The protuberances 27 are spaced away from the respective ends of the slide holder 22 so that when the slide holder is moved, for example, to its first or left-hand, circuit closing, position, as is shown in the top half of FIG. 2, one of the protuberances slides out from beneath the interior surface 26 of the top wall 21 and is exposed in the slotted aperture 20. Such exposure is visible and occurs with a relatively snapping action under the resilient influence of the slide member 10 providing an audible and mechanical indication that the slide holder has been moved fully to such position. The opposite protuberance acts similarly when the slide holder 11 is moved to its second or right-hand, circuit opening, position, as is illustrated in the lower half of FIG. 2. Moreover, a protuberance 27 exposed in a slotted aperture 20 also provides a locking function for the slide holder interferring with the top wall 21 at the edge of the slotted aperture 20 to resist movement of the slide holder until the latter is deliberately urged by the described pointed instrument or the like to an opposite position. As is evident, the height of the protuberances 27 above the major body of the slide holders 11 is less than the clearance of the slide holders above the traces 6 so that the slide holders normally will not engage the traces.

When the multiple switch device 1 is connected on-line, for example, between a multiple cable termination assembly and its receptacle, the respective slide switches 2 may be selectively positioned to close the respective circuits between the assembly and receptacle. Alternatively, the slide switches 2 may be adjusted to open all of those circuits or to open some of them, as desired, for example, to program the overall electrical apparatus in which the assembly, switch device 1 and receptacle are utilized to obtain prescribed circuit activity in that apparatus.

The embodiments of the invention in which an exclusive property or privilege is claimed are defined as follows:

1. A multiple switch mechanism connectable on-line between one multi-conductor electrical cable termination assembly device, a receptacle device for the latter, or a like device and another similar device for selectively opening and closing respective electrical circuits therebetween, comprising:

a plurality of first electrical contact means for connection with the respective contacts of such a device, a plurality of second electrical contact means for connection with the respective contacts of the other such device, a plurality of individually selectively operable slide switch means respectively electrically connected between said first and second electrical contact means for opening and closing respective circuit paths therebetween, said plurality of slide switch means including an electrically non-conductive support and a plurality of electrical conductors on said support, each of said plurality of electrical conductors including a pair of generally linearly extending conductor parts separated by an electrical discontinuity therebetween, and each of said slide switch means including electrically conductive slide means in engagement with a respective electrical conductor and slidable thereon to a first position for completing a circuit path between said conductor parts across a respective electrical discontinuity and to a second position to open such circuit path, thereby to close and to open, respectively, respective electrical circuits between such devices, and, dielectric housing means for holding in a common package at relative locations said first and second electrical contact means and said slide switch means, said dielectric housing means including a body of electrically non-conductive material integrally molded about at least respective portions of said electrical contact means, said support, and said electrical conductors to form an integral structure therewith.

2. A multiple switch mechanism as set forth in claim 1, wherein said first and second electrical contact means are positioned in respective dual-in-line patterns.

3. A multiple switch mechanism as set forth in claim 1, wherein each of said slide means comprises a resilient slide member, and each slide switch means further includes slide holder means for holding said slide member thereof to resilient engagement with said electrical conductor thereof.

4. A multiple switch mechanism as set forth in claim 3, wherein said body includes opening means for exposing a portion of said electrical conductors and said electrical discontinuities, and said dielectric housing means further comprises insert means attached to said body for substantially covering said opening means thereof, said insert means including a plurality of channel means for sliding containment of said respective slide holder means therewithin, and aperture means in a wall of said dielectric housing means for external access to said channel means, and wherein each of said slide holder means includes actuator means in a respective one of said aperture means and recessed below the exterior surface of said wall for moving said slide holder means and thus said slide member to such first and second positions.

5. A multiple switch mehanism as set forth in claim 3 wherein said dielectric housing means comprises means for guiding said slide holder means for movement in alignment with said electrical conductors, and further comprising means for signalling movement of said slide holder means substantially fully to each of such first and second positions.

6. A multiple switch mechanism as set forth in claim 3, wherein said dielectric housing means comprises guide means for guiding said slide holder means for movement in alignment with said electrical conductors, wherein said slide members cooperate with said slide holder means resiliently to urge said slide holder means to abutment with said guide means, and further comprising means on the surface of said slide holder means that is resiliently urged to engage said guide means for interfering with a portion of said guide means when said slide holder means is substantially fully in either one of such positions to resist movement thereof to the other of such positions.

7. A multiple switch mechanism as set forth in claim 1, wherein each pair of conductor parts comprises a pair of electrically conductive traces on said support, whereby said traces and said support form a printed circuit board.

8. A multiple switch mechanism as set forth in claim 7, wherein said electrical discontinuity comprises an open space between opposing end faces of a pair of traces extending generally non-perpendicularly to the major extent of the latter.

9. A multiple switch mechanism as set forth in claim 7, wherein said traces are printed on both sides of said support.

10. A multiple switch mechanism as set forth in claim 7, wherein said first and second electrical contact means are in electrical engagement with respective traces and said body comprises means for holding said electrical contact means and said traces in such engagement.

11. A multiple switch mechanism as set forth in claim 10, wherein said body is formed under elevated temperature and pressure conditions substantially to eliminate free oxygen and moisture at the area of engagement of said electrical contact means and said traces.

12. A multiple switch mechanism as set forth in claim 1, wherein one of said pluralities of electrical contact means comprises female-type contacts, and said dielectric housing means further comprises housing cover means over said female-type contacts for guiding male-type contacts to engagement therewith.

13. In a slide switch which includes an electrical conductor located on an electrically non-conductive support, said electrical conductor including first and second generally linearly extending electrically isolated conductor parts with an electrical discontinuity between respective opposing end faces of said conductor parts, and slide means urged toward abutment with said electrical conductor and slidable therealong and in engagement with a surface thereof to a first position engaging both said conductor parts for closing a circuit therebetween and to a second position engaging only one conductor part for opening such circuit, wheein the improvement comprises said opposing end faces having respective territorially overlapping portions relative to the major extent of the respective opposite conductor parts for maintaining said slide means in the plane of said surface as said slide means is moved from one to the other of such positions.

14. In a slide switch as set forth in claim 13, further comprising a dielectric housing including channel means for guiding said slide means for movement in alignment with said electrical conductor, said slide means comprising a resilient electrically conductive slide member and electrically non-conductive holder means slidable in said channel means for holding said slide member in engagement with said electrical conductor, aperture means in a wall of said dielectric housing for providing external access to said channel means, actuator means exposed in said aperture means for moving said slide means, and said holder means including protuberance means cooperable with said wall of said dielectric housing at the ends of said aperture means for indicating movement of said slide means substantially fully to such respective first and second positions.

15. In a slide switch as set forth in claim 13, further comprising a dielectric housing including channel means for guiding said slide means for movement in alignment with said electrical conductor, said slide means comprising a resilient conductive slide member and electrically non-conductive holder means for holding said slide member to engagement with said electrical conductor, said slide member resiliently urging said holder means to engagement with said dielectric housing, aperture means in a wall of said dielectric housing for providing external access to said channel means, actuator means exposed in said aperture means for moving said slide means, and said holder means including protuberance means for interfering with said wall of said dielectric housing at the ends of said aperture means to reist movement of said slide means from one of such positions toward the other of such positions.

16. In a slide switch as set forth in claim 13, wherein said electrical conductor and said support comprise a printed circuit board.

* * * * *